US006402430B1

(12) United States Patent
Guesnon

(10) Patent No.: US 6,402,430 B1
(45) Date of Patent: Jun. 11, 2002

(54) METHOD AND DEVICE FOR ADJUSTING THE BUOYANCE OF AN OFFSHORE DRILLING PIPE RISER

(75) Inventor: Jean Guesnon, Chatou (FR)

(73) Assignee: Insitut Francais Du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/416,960

(22) Filed: Oct. 13, 1999

(30) Foreign Application Priority Data

Oct. 13, 1998 (FR) ..... 98 12910

(51) Int. Cl.[7] ..... E21B 17/01
(52) U.S. Cl. ..... 405/224.2; 166/350
(58) Field of Search ..... 405/223.1, 224, 405/224.2, 224.4, 211, 195.1; 166/350, 359, 364, 365, 367

(56) References Cited

U.S. PATENT DOCUMENTS 3,855,656 A * 12/1974 Blenkarn ..... 166/350 X
3,992,889 A 11/1976 Watkins et al. ..... 405/224.2
4,040,264 A 8/1977 Neilon ..... 405/224.2
4,099,560 A 7/1978 Fischer et al. ..... 166/350
4,176,986 A 12/1979 Taft et al. ..... 405/211
4,422,801 A * 12/1983 Hale et al. ..... 166/350 X
5,046,896 A * 9/1991 Cole ..... 405/195.1
5,758,990 A * 6/1998 Davies et al. ..... 405/224.4
6,004,074 A * 12/1999 Shanks, II ..... 405/195.1

FOREIGN PATENT DOCUMENTS

FR 2400105 3/1979

* cited by examiner

*Primary Examiner*—David Bagnell
*Assistant Examiner*—Sunil Singh
(74) *Attorney, Agent, or Firm*—Antonelli, Terry, Stout & Kraus, LLP

(57) ABSTRACT

A riser for drilling with a subsea wellhead and a method for adjusting the boyancy of a pipe. The riser includes tubular elements (1) linked together by connecting devices (2). The elements include a floating device consisting of a box (6) in which a determined volume of gas can be pumped so as to modify the apparent weight of the element in the water. At least one tubular element comprises detectors (12) for measuring the differential pressure between the inside and the outside of the box, a value device (14) for filling the box with gas, a bleed valve device (15) for discharging the gas from the box, a control transmission and reception unit (13) for controlling the filling valve device and the discharge bleed valve device considering the differential pressure measurement.

8 Claims, 4 Drawing Sheets

METHOD AND DEVICE FOR ADJUSTING THE BUOYANCE OF AN OFFSHORE DRILLING PIPE RISER

FIELD OF THE INVENTION

The present invention relates to a device and to a method for adjusting the buoyancy of risers used for connecting a subsea wellhead to a floating drilling support.

BACKGROUND OF THE INVENTION

The risers used in the profession consist of tubular elements whose length ranges between 15 and 25 m (50 and 80 feet), linked together by connectors. The weight of these risers can be very great, which requires high-capacity suspension means at the surface. Furthermore, the stresses resulting from external loads on such a heavy element are high. It is therefore essential to decrease the apparent weight of these risers with lightening means. Known devices consist of buoy-type elements made from a light material and withstanding the hydrostatic pressure, sealed bottles filled with gas or buoyancy boxes comprising devices for filling them with air according to a predetermined surface adjustment.

The aforementioned device can be illustrated by document FR-2,314,347, which describes annular boxes concentric to a riser element comprising lower openings for water inflow and a device provided with a float for adjusting the water level, therefore the buoyancy level, in said box. This device does not allow buoyancy adjustment when the riser elements are assembled in the water depth.

Water depths can now reach 3000 m, which requires optimized remote-controlled buoyancy means.

SUMMARY OF THE INVENTION

The present invention thus relates to a riser for drilling with subsea wellhead comprising tubular elements linked together by connecting devices, the elements comprising a buoyancy device consisting of a box in which a determined volume of gas can be pumped so as to modify the apparent weight of said element in the water. At least one tubular element comprises means for measuring the differential pressure between the inside and the outside of said box, means for filling the box with gas, means for discharging the gas from the box, means for controlling the filling means and the discharge means considering said differential pressure measurement.

The tubular element of the riser can comprise means for receiving orders to fill or to empty said box.

The element can also comprise means for transmitting the differential pressure measurement to the surface.

The gas supply means can consist of pipes parallel to said tubular elements and linked together by said connecting devices.

The energy required for control can be provided by a hydraulic line similar to the gas supply line.

In the riser, at least one electric conductor can connect the lower and upper connector of a tubular element, and the connectors can link together the conductors of the various tubular elements.

The invention further relates to a method for adjusting the buoyancy of a riser for drilling with subsea wellhead comprising tubular elements linked together by connecting devices, said elements comprising each a floating device consisting of a box in which a determined volume of gas can be pumped so as to modify the apparent weight of said element in the water.

According to the method, the buoyancy of said element is calculated by measuring the differential pressure between the inside and the outside of the box, means for filling said box with gas or for emptying it from gas are controlled according to the desired buoyancy.

Control orders can be sent from the surface to at least one tubular element comprising means for receiving said orders in connection with the means for controlling the gas filling or discharge means.

BRIEF DESCRIPTION OF THE DRAWINGS

Other features and advantages of the invention will be clear from reading the description hereafter of non limitative examples, illustrated by the accompanying drawings wherein.

DETAILED DESCRIPTION

Figure 1:
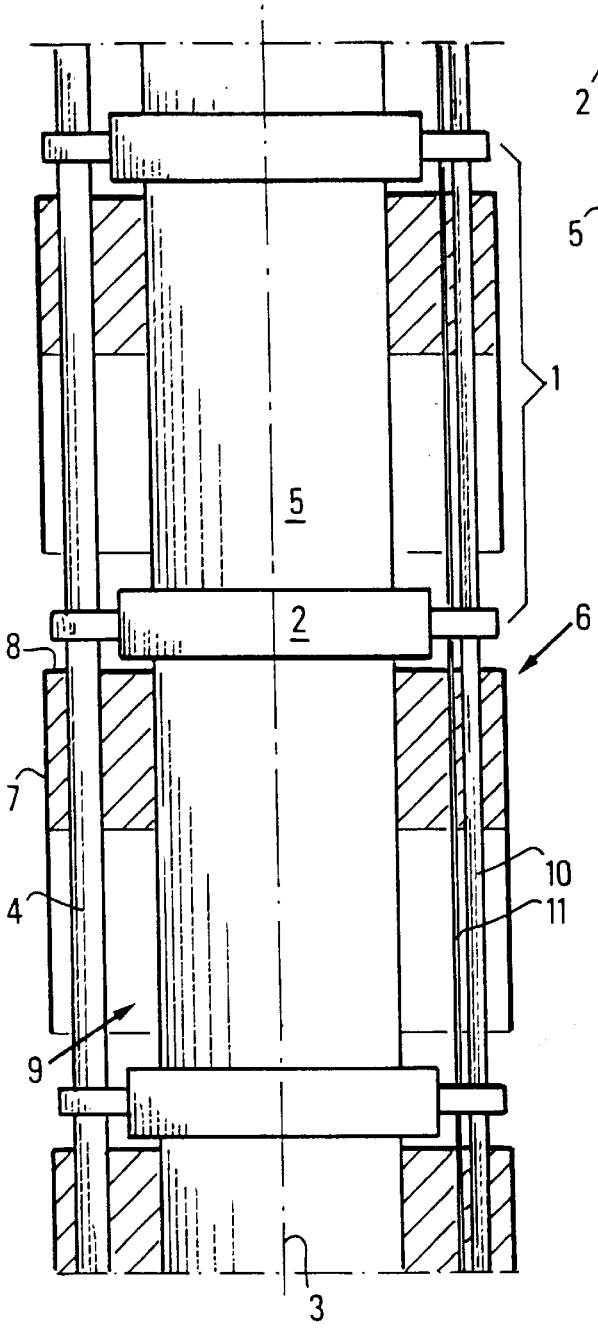
FIG. 1 diagrammatically shows several riser elements connected together.

In FIG. 1, reference number 1 refers to a tubular element of the riser. These elements 1 are linked together by means of mechanical connectors 2, for example those described in document EP-0147321 mentioned here by way of reference. Service lines are arranged parallel to the axis 3 of the riser so as to be <<integrated>> in the riser. Reference number 4 refers to a tubular line of the same length as element 1,that is automatically connected to the upper or lower line when elements 1 are linked together by connector 2. At least two lines 4 are arranged on the periphery of main pipe 5.These lines are referred to as a <<kill line>> and <<choke line)>>, and they are used to ensure well safety during inflow control procedures in the well.

Boxes 6 are concentrically mounted around main pipes 5. They consist of a cylindrical wall 7 and of a sealing cover 8 in the upper part. In the lower part of box 6, openings are provided to allow the seawater to enter the box or to be discharged therefrom.

A sealed tubular line 10 is mounted parallel to the main pipe, in the same way as the kill and choke lines. This continuous line is suited to supply all the boxes with compressed gas, neutral gas or air.

In a variant, another line 11,electric, hydraulic or electro-hydraulic, is added to the riser for buoyancy control of the riser. This line 11 is also set up when one joint 1 is connected to the other. In the case of an electric line, sealed plug-in connectors known to professionals are used.

Figure 2:
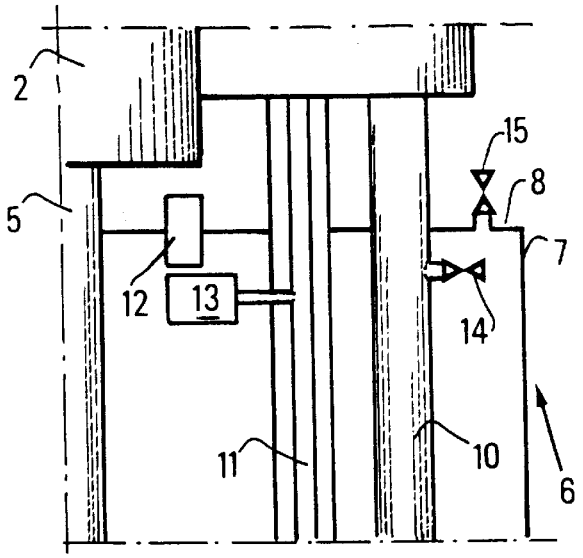
FIG. 2 shows, also diagrammatically and more in detail, the buoyancy control means for a riser element, FIG. 3 diagrammatically shows an example of realization of the adjusting means.

FIG. 2 diagrammatically shows the buoyancy control means. They are made up of at least four components:

- a series 12 of measuring detectors comprising at least one measurement of the differential pressure between the inside and the outside of box 6,preferably in the upper part of the box, for example near cover 8 or in the vicinity thereof,
- a control, transmission and reception unit 13 connected to the surface either by wireless, radio, electromagnetic or sonic type transmission, or by electric line 11,or by the hydraulic line, a pneumatic valve separation device 14 between compressed gas line 10 and the inside of box 6, a bleed valve device 15 suited to communicate the inside of the box with the outside.

These four components are connected so as to operate the two valves according to an order sent from the surface to unit 13. Valve 15 is opened when the buoyancy is to be decreased by emptying the boxes from gas. Valve 14 is opened when an increased buoyancy is desired by replacing water by gas.

The differential pressure measured by detector 12 is directly proportional to the gas level in the box, therefore proportional to the buoyancy. This measurement is simple and easy to perform even under marine conditions. Unit 13 receives this measurement by means of a conductor and compares the effective buoyancy with the set value sent from the surface by means of an electric conductor or any other transmission means. According to the difference between the measured value and the set value, unit 13 sends an order to one of valves 14 or 15 until the differential pressure measurement is in accordance with the desired buoyancy.

Figure 3:
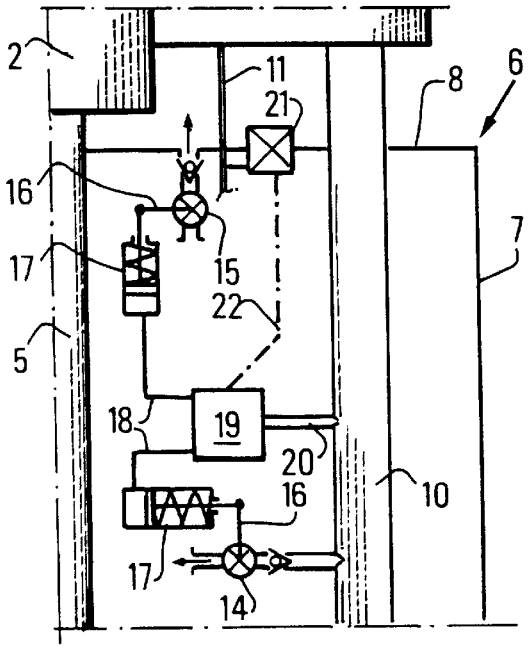

FIG. 3 diagrammatically shows an embodiment according to the invention for buoyancy adjustment of a riser joint 1. Valves 15 and 14 respectively control communication with the outside (seawater) and the compressed gas supply line (line 10). These valves can be spherical ball type valves quarter-turn operated by means of a lever 16. Each lever 16 is actuated by an operator 17,magnetic for example. An operator can be a single-acting jack system, with return to a position by means of a return spring. Thus, without pressure on the operator piston, the valves go into a position referred to as safety position: either open or closed. Each jack 17 is connected by a pneumatic line 18 to a distributor 19 or equivalent. The air pressure delivered by device 19 preferably comes from pressurized line 10 by means of a line 20. Distribution device 19 is controlled through orders received by control means 21 and takes account of the differential pressure measured between the inside and the outside of the box.

Figure 4A:
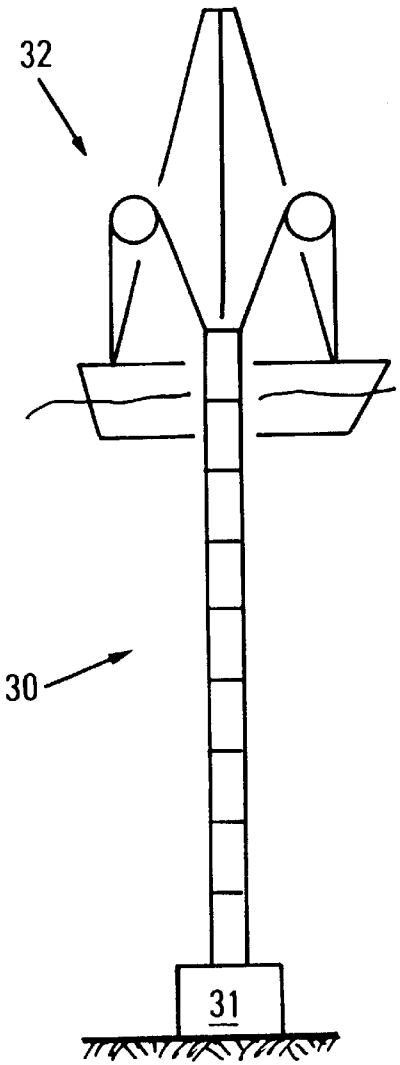
FIGS. 4*a*, 4*b*, 4*c* illustrate various buoyancy adjustment instances according to operating conditions.
Figure 4B:
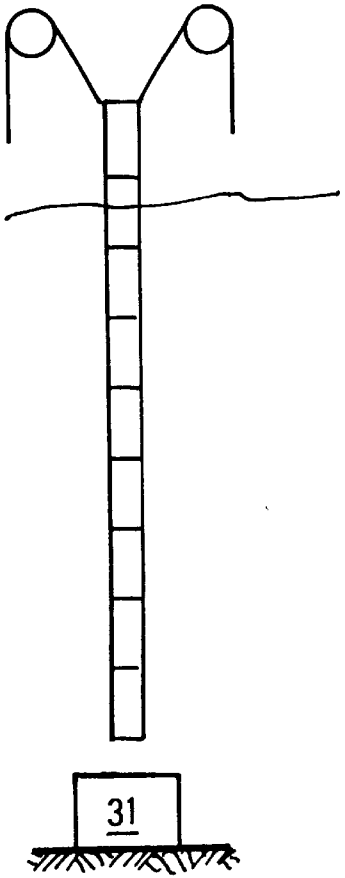
Figure 4C:
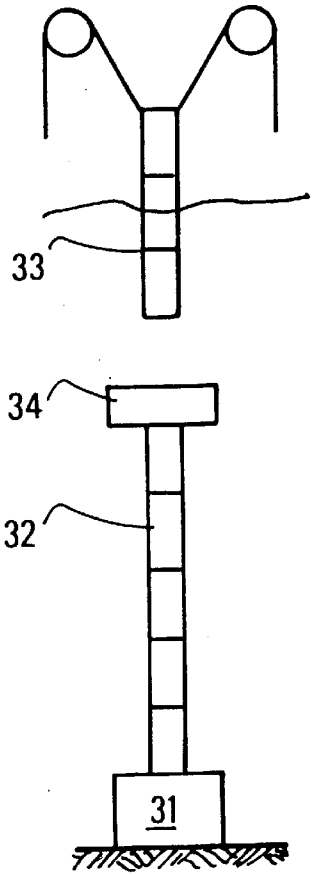

FIGS. 4*a*, 4*b*, 4*c* show three offshore instances where the present invention is advantageously applied.

FIG. 4*a* illustrates the case where the riser is assembled and connected to wellhead 31 and suspended from the other end of the riser by tension winches 32 that equip the floating support. In this case, considering the capacities of the winches, the own weight of the riser, the water depth (or the riser length), the currents, a maximum lightening of the riser is generally advisable. It is however important to be able to vary the lightening along the riser according to the depth of each element so as to control the stresses. This can be adjusted only with the riser joints according to the invention.

FIG. 4*b* illustrates the case where the riser is disconnected from the wellhead, for example to start pulling of the riser, or because of an emergency case where the floating support has to be moved out of line of the wellhead. In this case, mainly for reasons of mechanical resistance of the suspended riser, it is advisable to weight at least the lower end of the riser. Prior to disconnection, it is advantageous to discharge the air as quickly as possible and to fill with water at least the boxes of the lower joints.

FIG. 4*c* illustrates the case where a part 32 of the riser remains connected to subsea wellhead 31, the other part 33 remaining suspended below the floating support, or pulled out. An element 34 specific to this mode of disconnection comprises the connection and disconnection means and generally a buoy referred to as subsurface buoy for applying a tension onto part 32. It is clear that, in this case, buoyancy adjustment allows to go from a connected state to a disconnected state in complete safety for the riser.

Of course, application of the present invention is not limited to these cases only.

In order to allow better understanding of the advantages afforded by the present invention, a riser configuration comprising elements equipped with buoyancy boxes has been determined.

A first dimensioning of the air floats has been performed on the following basis:

length and thickness of the steel casings: 20 m and 5 mm respectively, mass of pieces joined on and reinforcements: 1000 kg, addition of two additional peripheral lines (for air control and injection).

The riser complies with the following base specifications:

water depth: 10000 ft (3048 m), riser diameter (main pipe TP): 21" OD (533.4 mm), main pipe steel: X80 of yield limit 80000 psi (560 MPa), riser joints effective length: 75 ft (22.86 m), peripheral lines:

(2) kill & choke lines $4^{1/2}$" ID×15000 psi (114.3 mm×1034 bar)

(1) booster line 4" ID mini×7500 psi (101.6 mm×517 bar)

(2) hydraulic lines 2" ID mini×5000 psi (50.8 mm×345 bar)

maximum density of the drilling mud: 17 ppg specified (2.04 kg/l), afterwards reduced to 15 ppg (1.80 kg/l), tensioning capacity of the riser brought to 2.56 Mip (1162 t) by means of 8 double tensioners of nominal tension 160 kip (usable at about 80%, i.e. 930 t in maximum tension at the riser top).

Study of the functionalities and of the dimensioning of these air floats would allow to refine these characteristics. Besides, using other materials than steel could be considered for the casings so as to lighten their structure.

The configuration given by way of example of the present invention is defined in the table hereafter:

| Element reference | Main pipe thickness (mm) | Floats diameter (inch) | Floats density | Unitary mass (t) | Apparent weight (t) | Number of elements | Total length (ft) |
|---|---|---|---|---|---|---|---|
| Telescop. | 25.4 | — | — | (25) | (25) | (1) | 100 |
| CF14NF | 22.2 | — | bare joints | 14.2 | 12.3 | 5 | 375 |
| CF13B20 | 20.6 | 53" | 0.39 | 22.1 | −1.4 | 21 | 1575 |
| CF12B40 | 19.1 | 53" | 0.45 | 22.9 | −0.5 | 27 | 2025 |
| CF11B60 | 17.5 | 53" | 0.51 | 23.8 | 0.5 | 26 | 1950 |

-continued

| Element reference | Main pipe thickness (mm) | Floats diameter (inch) | Floats density | Unitary mass (t) | Apparent weight (t) | Number of elements | Total length (ft) |
|---|---|---|---|---|---|---|---|
| CF12B80 | 19.1 | 53" | 0.60 | 26.1 | 2.8 | 27 | 2025 |
| CF13AC | 20.6 | 50" | full of water | 18.1 | 15.8 | 26 | 1950 |
| (floats) | | | full of air | | −3.8 | | |
| | | | | 2945 | 519 | 132 | 10000 |
| | | | | | 8 | | |

Conversion to SI units:

1 inch=25.4 mm-1 foot=304.8 mm-1 kg/l=8.35 ppg.

Figure 5:
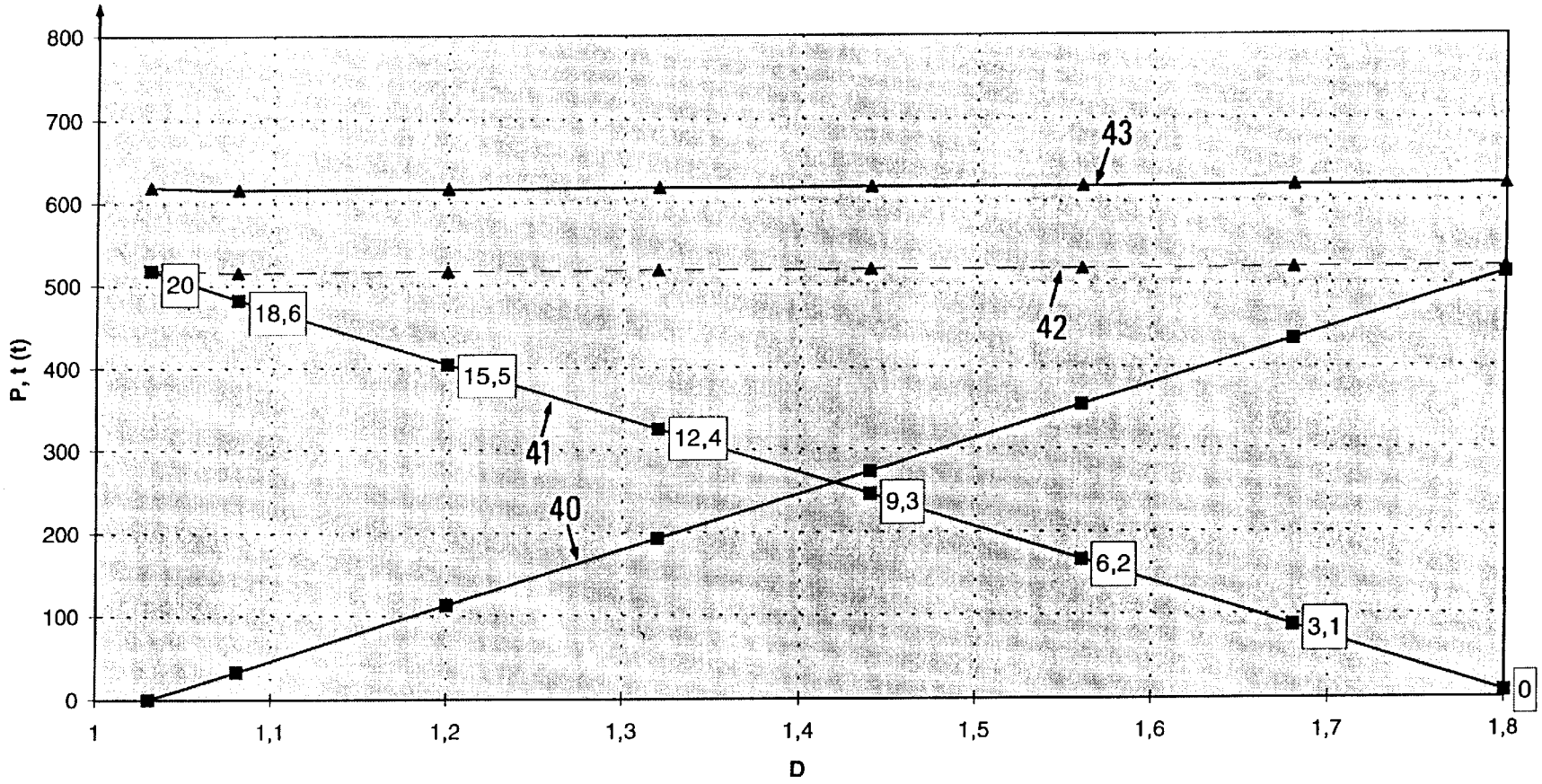
FIG. 5 illustrates buoyancy adjustment of the riser, FIG. 6 describes the stresses for a given configuration.

The apparent weight of the mud ranging between 0 t (seawater) and 513 t (at 15 ppg), the riser+mud weight and the tension at the top of the riser can remain constant provided that the water level in the casings is adjusted according to the mud density. FIG. 5 illustrates this procedure.

This figure shows, as a function of the mud density D laid off as abscissa, the apparent weight of the mud (curve 40), the apparent weight of the riser (curve 41) obtained by adjusting the water level in the casings to the value (in meters) given in the boxes, and the sum thereof (curve 42) to which it is sufficient to add about a hundred tons to obtain the tension (curve 43) to be applied to the riser top, which in this case is of the order of 620 t.

This principle of floats that allows to work with a constant tension at the top of the riser, whatever the density of the mud used, would allow, with adjustment of the diameter of the casings, to work with muds heavier than 15 ppg, that can reach 17 ppg (with a tension at the top of about 750 t), or more if necessary.

It can be noted that maintaining a constant tension on the riser during drilling would also have the advantage of ensuring, under any circumstance, optimum stability of the riser towards lateral stresses (swell and current) and could lead to a simplification of the tensioning system the floating support is equipped with.

Figure 6:
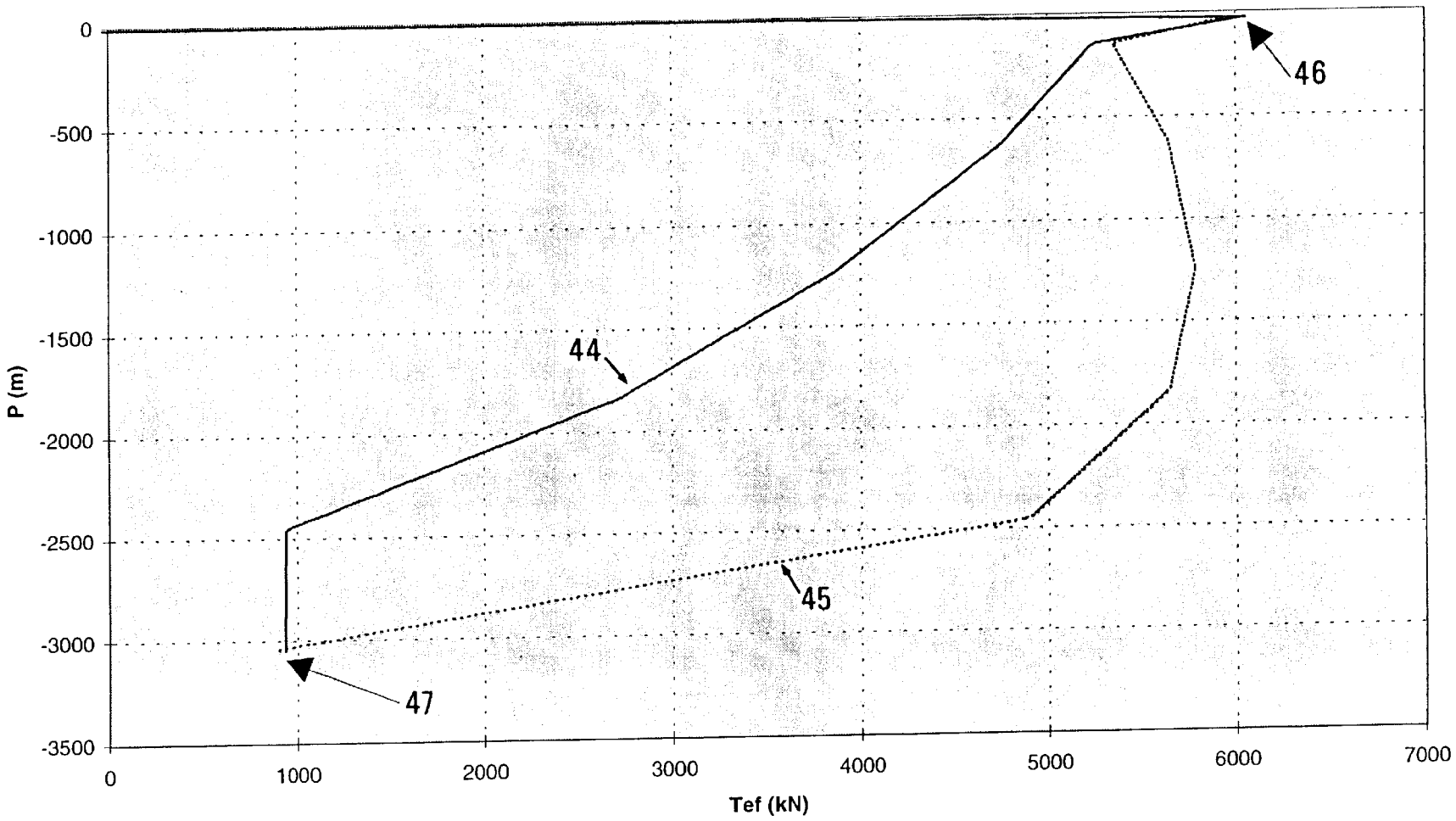

The working principle of the present riser can notably be illustrated by the tensive strain curves shown in FIG. 6.

The following observations can be made in view of these results:

The working principle of the riser with air floats is clearly visible when comparing, in FIG. 6, curve 44 (connected riser full of mud, d=1.8 kg/l) and curve 45 (connected riser full of seawater, d=1.03 kg/l). In both cases, the tension at the top (reference number 46) is the same, as well as the tension at the bottom (reference number 47), whereas the weight of the mud is very different. The difference is due to the apparent weight of the last section (equipped with the air floats), which causes the lower part of the curve to rise or to incline.

The result is an angle at the riser bottom maintained (approximately) at 2° in both cases. In a full of mud situation, the zero apparent weight of the lower part of the riser eliminates the catenary effect and the angle remains constant. Full of water with ballasted floats, this catenary effect plays a full role and the angle exceeds 2°, but it could easily be reduced by injecting some air into the floats.

What is claimed is:

1. A riser for drilling with subsea wellhead comprising tubular elements linked together by connecting devices, said elements comprising a buoyancy device consisting of a box in which a determined volume of gas can be pumped so as to modify the apparent weight of said element in the water, characterized in that at least one tubular element comprises means for measuring the differential pressure between the inside and the outside of said box, means for filling the box with gas, means for discharging the gas from the box, means for controlling the filling means and the discharge means considering said differential pressure measurement.

2. A riser as claimed in claim 1, wherein said at least one tubular element comprises reception means for receiving an order to fill or to empty said box.

3. A riser as claimed in claim 2, wherein said at least one tubular element comprises means for transmitting the differential pressure measurement to the surface.

4. A riser as claimed in claim 1, wherein the gas supply means consist of pipes parallel to said tubular elements and said pipes are linked together by said connecting devices.

5. A riser as claimed in claim 4, further comprising a hydraulic line parallel to said parallel pipes for providing energy required for buoyancy control of the riser.

6. A riser as claimed in claim 1, wherein a plurality of tubular elements are provided and at least one electric conductor links upper and lower connecting devices of each tubular element together and said connectors link each electric conductor of the tubular elements together.

7. A method for adjusting the buoyancy of a riser for drilling with subsea wellhead comprising tubular elements linked together by connecting device, said tubular elements comprising each a floating device consisting of a box in which a determined volume of gas can be pumped so as to modify the apparent weight of said element in the water, characterized by the following stages:

calculating the buoyancy of said elements by measuring the differential pressure between the inside and the outside of the box, filling said box with gas or discharging gas from according to the calculated buoyancy.

8. A method as claimed in claim 7, further comprising sending an order from the surface to at least one tubular element in order to fill the box with gas or discharge gas from the box.

* * * * *